US005377662A

United States Patent [19]

Mills et al.

[11] Patent Number: 5,377,662

[45] Date of Patent: Jan. 3, 1995

[54] FURNACE DOOR ATTACHMENT

[75] Inventors: Rex R. Mills, Indianapolis; Timothy J. Waterman, Carmel; Randel K. Patterson, Plainville; Allen L. Sherven, Brownsburg, all of Ind.

[73] Assignee: Carrier Corporation, Syracuse, N.Y.

[21] Appl. No.: 127,002

[22] Filed: Sep. 24, 1993

[51] Int. Cl.[6] ..... F24H 3/02

[52] U.S. Cl. ..... 126/110 R; 126/190; 292/DIG. 69

[58] Field of Search ..... 126/110 R, 114, 98, 126/190; 110/181; 292/86, 70, 17, 184, DIG. 69; 49/394

[56] References Cited

U.S. PATENT DOCUMENTS

| | | | |
|---|---|---|---|
| 2,526,532 | 10/1950 | Bedford, Jr. | 24/73 |
| 2,546,674 | 3/1951 | Milhouse | 126/114 X |
| 3,261,628 | 7/1966 | Kesling | 292/70 |
| 3,357,419 | 12/1967 | Duchinsky | 126/114 |
| 4,772,111 | 6/1981 | Hammer, Jr. et al. | 292/17 |
| 4,865,366 | 9/1989 | Kretchman | 292/86 |
| 5,243,771 | 9/1993 | Kretchman et al. | 126/190 X |
| 5,322,051 | 6/1994 | Patterson et al. | 126/110 R |

*Primary Examiner*—Larry Jones

[57] ABSTRACT

A furnace of the type for supplying circulating heated air to an comfort space, the furnace being contained within a cabinet, having a door allowing access to the interior thereof, which is set in a door frame, wherein the furnace is capable of operating in at least any vertical orientation, an improvement comprising. The bottom end of the door is removably retained against a bottom portion of the door frame, via a hinge, when the furnace is any vertical orientation. At least one latch is located adjacent the top end of the door when the furnace is in any vertical orientation, the latch being constructed to engage a mated door strike; and at least one door strike is located in both a top portion and a bottom portion of the door frame.

9 Claims, 4 Drawing Sheets

FURNACE DOOR ATTACHMENT

BACKGROUND OF THE INVENTION

1. Field of the Invention

This invention relates to a furnace for providing circulating heated air to an interior comfort space where the furnace is capable of being operated in one of four physical orientations, and is more particularly directed to a door which will remain upright when the furnace is either in the up or the down vertical orientation and will also be usable in either of the two possible horizontal orientations, namely left or right.

2. Description of the Prior Art

Under normal circumstances, securing a furnace door is an operation that needs to meet but a few requirements. The door must open easily but remain tightly and securely closed when not deliberately opened. This is due to the fact that furnaces are generally situated outside of ordinary living spaces as in, for example a basement or a closet, and so are apt to be exposed to large amounts of dust and dirt. It is desirable that such dust and dirt, as well as moisture, be kept out of the internal functioning portions of the furnace.

It is also desirable that a furnace door present a smooth external appearance without bolts or other hardware showing. This is true not only for the aesthetic appearance, at least of a new furnace, but also because external parts may become corroded.

A furnace door should also be easily removable, so as to provide complete access to the interior of the furnace for servicing. In addition, it is desirable that no parts have to be removed in order to detach the door. The removal of small parts takes time, as does their replacement, and they can become lost during the process of furnace repair. It is also desirable there be a detente so that the door cannot be opened so far as to accidentally be removed, especially by an unwary householder. Lastly, the door serves as a repository, both inside and out, for indicia of various types; these include the manufacturer's name and/or logo and various warning and informational stickers which may be critical to the owner and/or repair-person.

In the instant case, the furnace on which the door is to be attached is capable of operation in any one of four positions. The furnace may be installed vertically in either updraft or downdraft position, or horizontally, on either its left or its right side. Occasionally the direction of installation may not be known until the installer is actually on site.

Whether the furnace is installed in updraft or downdraft orientation, however, it is desirable for the door to be in an upright position. In this context this means that the door will always open from the top down. It also means that the indicia on the door are always right side up when the furnace is in a vertical position, and are thus easily readable. Thus the door should be reversible on site so that it remains upright whether the furnace is installed in a vertical up or a vertical down position.

In the observed prior art, doors are attached to the furnaces via clips, but this arrangement does not meet the requirements of different installation orientations.

SUMMARY OF THE INVENTION

It is therefore a primary object of the present invention to provide a furnace door attachment wherein the furnace door remains upright whether the furnace is installed in either updraft or downdraft orientation.

It is a further object of the present invention to provide a furnace door attachment where no attachment hardware is visible on the exterior of the furnace.

It is still another object of the present invention to provide a furnace door attachment wherein the furnace door remains securely shut in the closed position.

It is yet another object of the present invention to provide a furnace door attachment wherein the furnace door opens from the top down with the furnace installed in either updraft or downdraft orientation.

It is still another object of the present invention to provide a furnace door attachment in which the furnace door is easily installed in an upright position whether the furnace is installed in either updraft or downdraft orientation.

It is a further object of the present invention to provide a furnace door attachment wherein the furnace door can be easily removed and reinstalled without having to remove any parts.

These and other objects of the present invention are attained by, a furnace of the type for supplying circulating heated air to an comfort space, the furnace being contained within a cabinet, having a door allowing access to the interior thereof, which is set in a door frame, wherein the furnace is capable of operating in at least any vertical orientation, an improvement comprising. The bottom end of the door is removably retained against a bottom portion of the door frame, via a hinge, when the furnace is any vertical orientation. At least one latch is located adjacent the top end of the door when the furnace is in any vertical orientation, the latch being constructed to engage a mated door strike; and at least one door strike is located in both a top portion and a bottom portion of the door frame.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
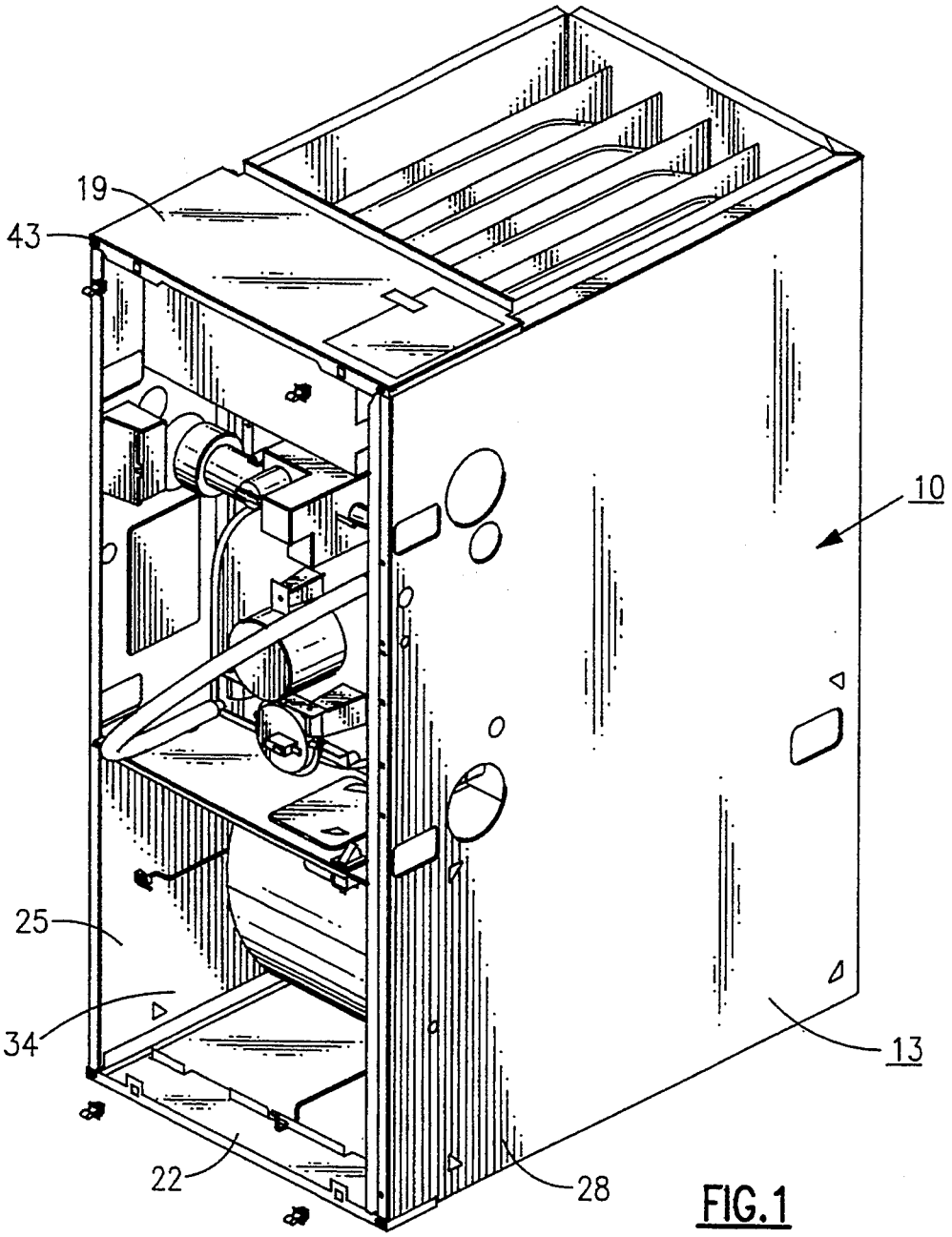
FIG. 1 is a perspective, exploded view of the furnace of the present invention, with the door off.

Referring now to FIG. 1 there can be seen, generally the multipoise or multi-position furnace 10 to which this invention relates. The furnace 10 is comprised of two main components, the furnace cabinet 13 and the furnace door 30, seen in FIG. 3. The furnace cabinet 13 has four sides on which it may rest: the top 19, bottom 22, left side 25, and right side 28. When situated as shown in FIG. 1 with the top uppermost (and the blower directing air upward) the orientation is updraft. A reversal of 180° with the blower directing air downward is the downdraft orientation. The draft may also be directed either to the right or to the left.

Figure 3:
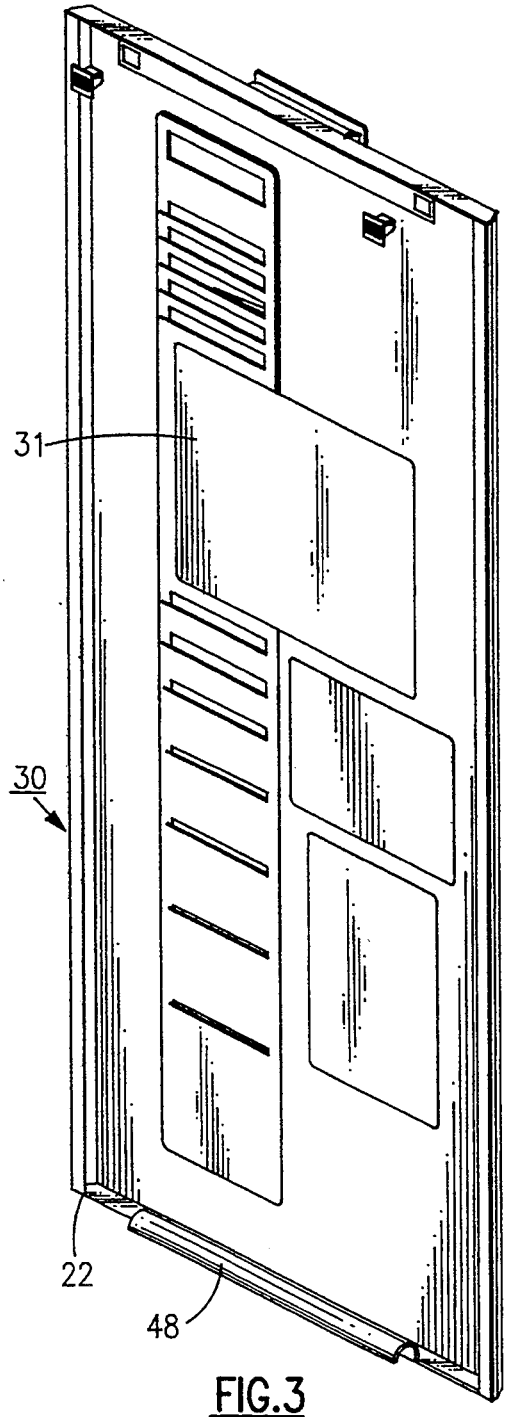
FIG. 3 is a perspective view of the back of the door of the present invention.

On the door back 16, as can be seen in FIG. 3 are various indicia 31 such as warning and certification labels. Other indicia and labels as well as the trademark and/or logo of the manufacturer may appear on the door front (not shown). If the furnace door was fixed in place relative to the furnace cabinet, these indicia would be easily readable in the up draft mode and readable by tilting the head when the draft is directed either to the right or to the left. However in the downdraft mode the indicia would be upside down and readable only with some difficulty.

Figure 11:
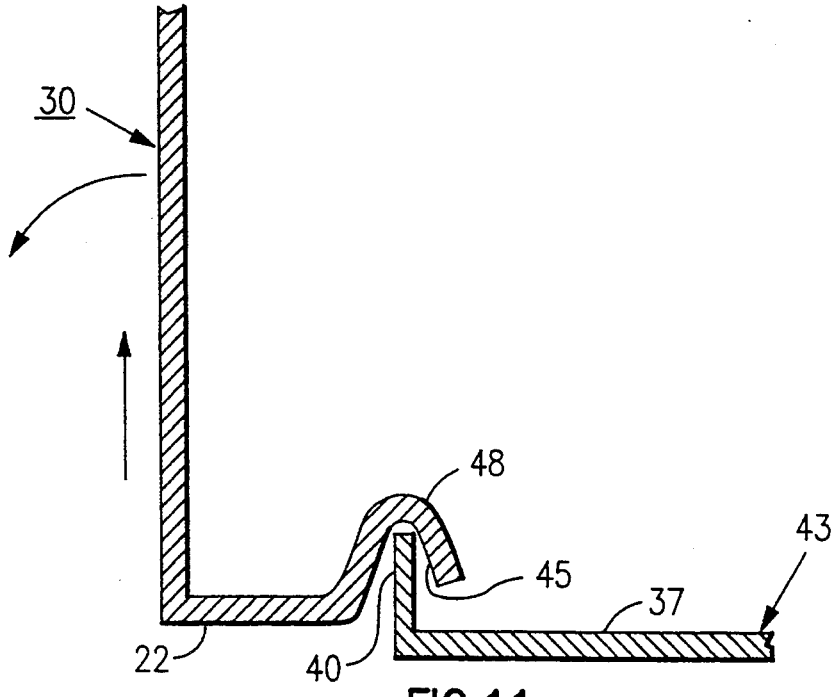
FIG. 11 is a schematic representation of a side view showing the attachment of the door bottom to the furnace of this invention.

FIG. 11 shows the installation of the door with respect to the cabinet. The bottom of the cabinet opening 34 is symmetrical with respect to the top. Therefore for the purposes of the following discussion, the terms "lower" and "floor" will be used to delineate that portion of the furnace cabinet closer to the ground and on the ground respectively and "upper" that portion of the cabinet further from the ground irrespective of whether the updraft or downdraft orientation is being used. The bottom plate or floor 37 of the cabinet, then, rests upon the ground or other substructure. From it, and perpendicular thereto is a ledge 40 which forms the lower boundary of door frame 43. Extending outward from and perpendicular to the bottom 22 of the furnace door 30 is a lip 48 having all or part of its undersurface curved so as to rest upon and pivot hingedly against ledge 40. When in the open position, the door 30 is held against the door frame 43 by virtue of the restricted motion allowed to it by the lip undersurface 45 restraining the ledge 40. It can only open a predetermined degree, in the instant case to an angle of between 15 and 45°. In the preferred embodiment the maximum angle of opening is approximately 30°. The door can alternatively be lifted off the ledge 40, without having to remove or loosen any hardware, and be set aside for maximum access to the interior of the furnace.

Figure 2:
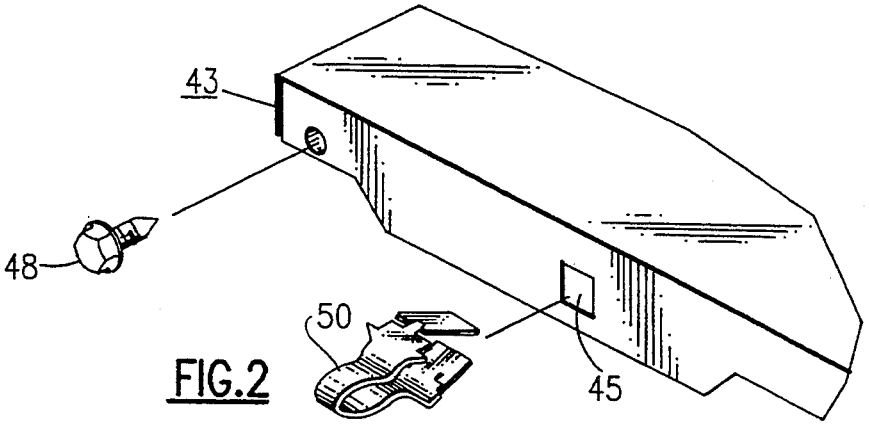
FIG. 2 is an enlarged view of the door frame of the furnace of FIG. 1.

In the door frame, as can be more clearly seen in FIG. 2, are inserted four (4) door strikes 50,50. A single door strike is presented in more detail in FIGS. 5–8. It is comprised of a body 52 and two flanges 54,54 formulated from any suitable metal, having spring characteristics, as is well known in the art. The body is shaped of two stretched out "S" shapes, joined together at one end to form a narrow closed portion 56 and remaining apart at the other end to form a wide open portion with two ends 58,58. A plane of symmetry runs from closed end to open end. The narrow closed end engages into a corresponding opening in a corresponding door latch 70. To the ends 58,58 are attached springing flanges 54,54. Each door strike 50 when placed flange first into the appropriate receptacle 45 in door frame 43 will be retained therein by spring action. Pressure on the springing flanges 54,54 exerted from the back side of the receptacle, will release the door strike for replacement in case of damage.

Figure 4:
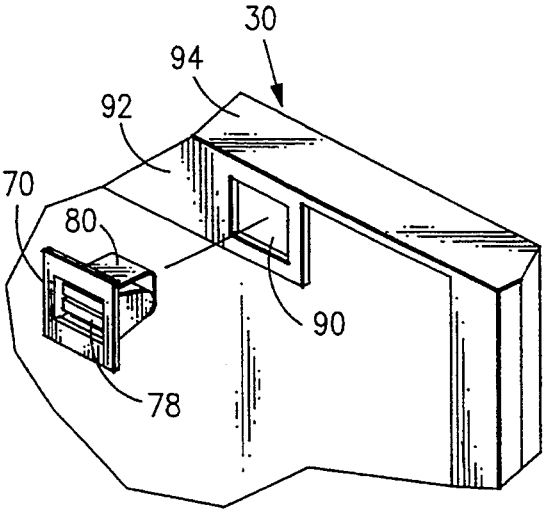
FIG. 4 is a detailed view of the door of FIG. 1 showing the placement of a latch in the door.
Figure 5:
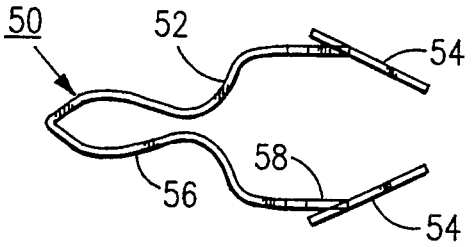
FIG. 5 is a top view of the door strike of the present invention.
Figure 6:
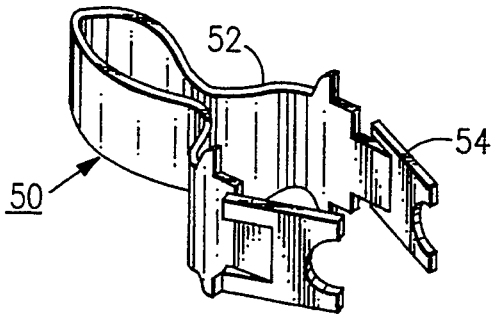
FIG. 6 is a perspective view of the door strike of FIG. 5.
Figure 7:
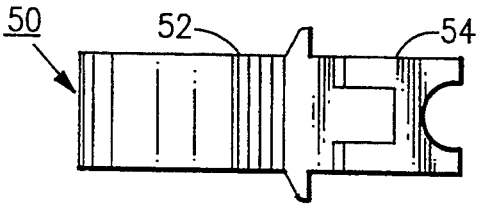
FIG. 7 is a side view of the door strike of FIG. 5.
Figure 8:
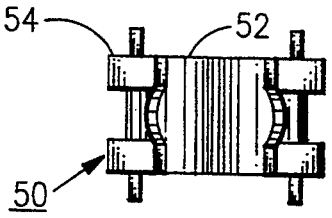
FIG. 8 is a front view of the door strike of FIG. 5.
Figure 9:
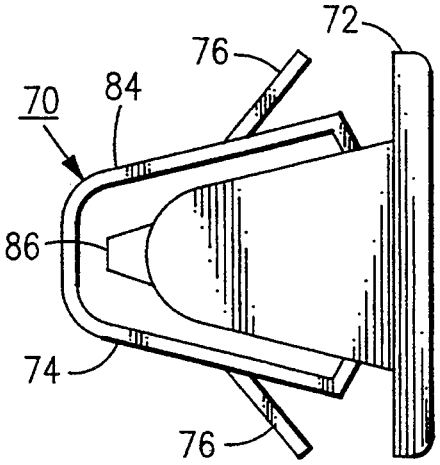
FIG. 9 is a top view of the latch of the present invention.
Figure 10:
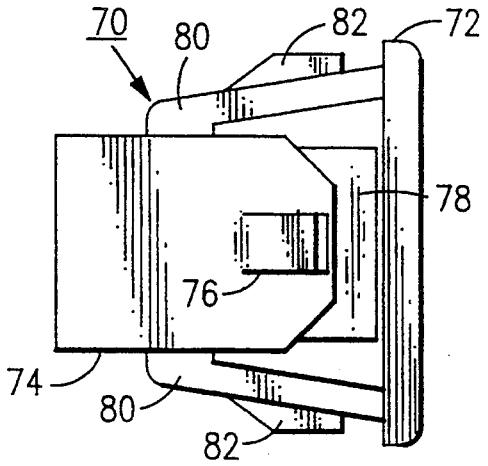
FIG. 10 is a side view of the latch of FIG. 9.

In the door 30, as can be more clearly seen in FIG. 4, are inserted two (2) latches 70,70. These latches appear in more detail in FIGS. 9–10. They are constructed so that, like the door strikes, they can be inserted into mating receptacles 90,90 where they will be held in place by spring action until released, again from behind.

Each latch 70 is comprised of two outer spring portions. Outer spring portion 84, has two flanges 76,76 extending therefrom and an inner spring portion 78. The flanges 76,76 are intended to engage the sides of the latch receptacle 90 in the door 30. Outer spring portion 80 contains two protrusions 82,82 which engage the top and bottom surfaces of latch receptacle 90. Inner spring portion 78 is shaped to removably retain therein the narrow end 56 of door strike 50, so that it will take a degree of force to engage the door strike in the latch and also a degree of force to remove the door strike from the latch. Thus the door closes positively and, once closed, should remain so until it is deliberately opened.

The two latches 70,70 are positioned at the top of the door and, whether the furnace is in the updraft or the downdraft position, will engage with the two door strikes which are in the uppermost positions of the door frame. Receptacles 45,45 are merely holes cut in the door frame as the spring action of each door strike prevents it from passing out of the receptacle once engaged unless the spring is compressed. Similarly, receptacles 90,90 are merely holes cut in the door as the spring-like action of each latch, together with flanges 76,76 and protrusions 82,82 prevents it from passing out of the receptacle once engaged unless the spring is compressed. The door receptacle is formed in a portion of the door that has undergone a double 90° fold from the door surface, so that it is formed in strip 92 which is parallel to and behind the main portion of door 30, and attached thereto via perpendicular strip 94. Thus the receptacle and latch is totally invisible when the furnace door is closed and none of the components of the furnace door closure system extends to the outside of the furnace. Because of this construction there is no entrance route for contaminants from outside the furnace to reach the furnace interior, and a minimum of hardware is needed to effect door closure in either the updraft or downdraft position.

It should be understood that while this embodiment is the preferred one, other methods of latching the door closed which are well known in the art can be substituted for the specific latch and door strike described.

While this invention has been explained with reference to the structure disclosed herein, it is not confined to the details set forth and this application is intended to cover any modifications and changes as may come within the scope of the following claims:

What is claimed is:

1. In a furnace of the type for supplying circulating heated air to an comfort space, the furnace being contained within a cabinet, having a door allowing access to the interior thereof, said door having a top end, and a bottom end, and being set in a door frame, wherein the furnace is capable of operating in at least any vertical orientation, an improvement comprising:

hinging means on said door for removably retaining the bottom end of said door against a bottom portion of said door frame when the furnace is any vertical orientation;

engaging means located adjacent the top end of the door when the furnace is in any vertical orientation, said engaging means being constructed to engage a mated retaining means; and retaining means located in both a top portion and a bottom portion of the door frame.

2. The apparatus of claim 1 wherein said door is removable from said door frame by opening said door and lifting said door from said door frame.

3. The apparatus of claim 1 wherein said hinging means comprises a grooved region extending substantially perpendicularly from the bottom of the door toward the door frame and resting along a corresponding lip forming a lower edge of said door frame.

4. The apparatus of claim 1 wherein said retaining means comprises a latch inset within a correspondingly sized recess in the door and said engaging means comprises a door strike inset within a correspondingly sized recess in said door frame.

5. The apparatus of claim 4 wherein two pairs of door strikes are located facing outwardly in said door frame, each door strike being located generally at one corner region of said door frame, and two latches are located facing inwardly in said door, each latch being located generally in a top region of said door in a position corresponding to a door strike.

6. The apparatus of claim 4 wherein said door strikes and said latches are each retained in a respectively cut out recess in said door frame and said door via spring action.

7. The apparatus of claim 4 wherein said recesses for said latches are inset in a turned back section of said door which is parallel and behind a front surface of said door.

8. The apparatus of claim 1 wherein said furnace may additionally be placed in a horizontal orientation, and where said hinging means retains said door against a first side portion of said door frame when the furnace is a horizontal orientation and said engaging means is located adjacent a second side portion of said door frame.

9. The apparatus of claim 8 wherein said hinging means comprises a grooved region extending substantially perpendicularly from the bottom of the door toward the door frame and resting along a corresponding lip forming a lower edge of said door frame and said lip and groove are formed so that said door remains on the door frame when the furnace is a horizontal position and the door is opened.

* * * * *